US007533423B2

(12) United States Patent
Rudolph

(10) Patent No.: US 7,533,423 B2
(45) Date of Patent: May 19, 2009

(54) EQUESTRIAN RIDING BREECHES GARMENT AND METHOD FOR ITS MANUFACTURE

(75) Inventor: Sheryl Rudolph, Portland, OR (US)

(73) Assignee: Fun In The Saddle, Inc., Portland, OR (US)

( * ) Notice: Subject to any disclaimer, the term of this patent is extended or adjusted under 35 U.S.C. 154(b) by 528 days.

(21) Appl. No.: 11/198,075

(22) Filed: Aug. 5, 2005

(65) Prior Publication Data

US 2006/0230488 A1 Oct. 19, 2006

Related U.S. Application Data

(60) Provisional application No. 60/671,964, filed on Apr. 15, 2005, provisional application No. 60/683,212, filed on May 20, 2005.

(51) Int. Cl.
*A41D 1/06* (2006.01)

(52) U.S. Cl. ..... 2/227; 2/269; 2/23

(58) Field of Classification Search ..... 2/466, 2/23, 24, 61, 79, 81, 227, 228, 231, 267
See application file for complete search history.

(56) References Cited

U.S. PATENT DOCUMENTS 218,472 A * 8/1879 Banner ..... 2/231
337,316 A * 3/1886 Erlanger ..... 2/231
344,156 A * 6/1886 Bosenberg ..... 2/231
440,989 A * 11/1890 Appel ..... 2/231
541,334 A * 6/1895 Roschi ..... 2/227
552,785 A * 1/1896 Shrier ..... 2/227
907,050 A * 12/1908 Hestness ..... 2/23
967,023 A * 8/1910 Larkin ..... 2/227
1,099,875 A * 6/1914 Fuiks ..... 2/227
1,633,610 A * 6/1927 Schneider ..... 2/407
1,831,930 A * 11/1931 Speh ..... 2/227
1,838,022 A * 12/1931 Lieberman ..... 2/228
1,863,482 A * 6/1932 Isaacs ..... 2/228
1,880,570 A * 10/1932 Weitzenhoffer ..... 2/228
2,119,602 A * 6/1938 Roberts et al. ..... 2/227
2,146,494 A * 2/1939 Adamson ..... 2/228
2,316,588 A * 4/1943 Isaacs ..... 2/227
2,568,083 A * 9/1951 Mitchell ..... 2/231
3,552,154 A * 1/1971 Lesley ..... 66/192

(Continued)

OTHER PUBLICATIONS

Roth, excerpted page from online catalogue, p. 29, DEGOPA GmbH, http://www.kinnkette.de/cms/index.php?id=139&L=1, Germany.

(Continued)

*Primary Examiner*—Alissa L Hoey
(74) *Attorney, Agent, or Firm*—Ater Wynne LLP

(57) ABSTRACT

An equestrian riding garment includes a pair of pants of elastic material having inner leg expanses and a butt expanse of durable material affixed to corresponding regions thereof, the inner leg and butt expanses being made of real or faux leather that is perforated to increase air permeability and to promote friction with a saddle. Preferably, the butt expanse is bifurcated into left and right sub-pieces corresponding with the equestrian's left and right buttocks. Optionally, a knee region of the inner leg expanses is articulated, as by segmenting. Optionally, an abdominal and/or inner calf region of the pair of pants includes an inner support layer of extra fabric for more flattering fit.

21 Claims, 5 Drawing Sheets

U.S. PATENT DOCUMENTS 3,761,962 A * 10/1973 Myers ..... 2/79
3,763,498 A * 10/1973 Rector ..... 2/2.15
3,813,697 A * 6/1974 Belpaume ..... 2/227
4,035,844 A * 7/1977 Atack et al. ..... 2/466
4,261,060 A * 4/1981 Zawacki ..... 2/227
4,470,156 A * 9/1984 Duerbeck et al. ..... 2/227
4,488,317 A * 12/1984 Polsky ..... 2/227
4,561,124 A * 12/1985 Thompson ..... 2/23
4,580,297 A * 4/1986 Maejima ..... 2/22
4,613,991 A * 9/1986 Grover ..... 2/23
4,670,913 A * 6/1987 Morell et al. ..... 2/227
4,688,269 A * 8/1987 Maeshima ..... 2/456
4,700,407 A * 10/1987 Mattila ..... 2/465
4,791,685 A * 12/1988 Maibauer ..... 2/227
4,831,666 A * 5/1989 Denman ..... 2/23
4,843,654 A * 7/1989 March ..... 2/227
4,850,056 A * 7/1989 Gardner et al. ..... 2/227
4,894,867 A * 1/1990 Ceravolo et al. ..... 2/238
4,920,577 A * 5/1990 Scharf ..... 2/24
4,922,551 A * 5/1990 Anthes ..... 2/79
4,987,613 A * 1/1991 Loverdi et al. ..... 2/23
5,014,354 A * 5/1991 Dumont ..... 2/23
5,022,094 A * 6/1991 Hames et al. ..... 2/163
5,031,242 A * 7/1991 Aldridge et al. ..... 2/81
5,033,126 A * 7/1991 Wruck et al. ..... 2/242
5,038,408 A 8/1991 DeBaene
5,068,920 A * 12/1991 Bray ..... 2/456
5,105,473 A * 4/1992 Valtakari ..... 2/461
5,161,257 A * 11/1992 Arensdorf et al. ..... 2/465
5,210,877 A 5/1993 Newman
D343,496 S * 1/1994 Spoor et al. ..... D2/747
5,375,262 A * 12/1994 Carter ..... 2/23
5,377,693 A * 1/1995 Loper et al. ..... 128/845
5,539,926 A * 7/1996 Mantos ..... 2/23
5,551,082 A * 9/1996 Stewart et al. ..... 2/465
5,551,091 A * 9/1996 Tyndall ..... 2/227
5,560,042 A * 10/1996 Schlesner ..... 2/46
5,572,737 A * 11/1996 Valice ..... 2/465
5,634,215 A * 6/1997 DeBaene ..... 2/227
5,689,836 A * 11/1997 Fee et al. ..... 2/465
D411,907 S * 7/1999 Kling ..... D2/742
5,918,319 A * 7/1999 Baxter ..... 2/455
6,035,442 A * 3/2000 Marando ..... 2/161.1
6,041,437 A * 3/2000 Barker et al. ..... 2/82
6,070,274 A * 6/2000 van der Sleesen ..... 2/456
6,085,353 A * 7/2000 van der Sleesen ..... 2/69
6,115,838 A * 9/2000 Scholtis et al. ..... 2/46
6,161,222 A * 12/2000 Strickland et al. ..... 2/228
6,260,196 B1 * 7/2001 van der Sleesen ..... 2/2.5
6,282,729 B1 * 9/2001 Oikawa et al. ..... 2/465
6,327,713 B1 * 12/2001 Gomez ..... 2/227
6,327,715 B1 * 12/2001 Castiglione ..... 2/267
6,338,164 B1 * 1/2002 Howard ..... 2/242
6,347,403 B1 * 2/2002 Wilcox ..... 2/23
6,401,250 B1 * 6/2002 McNabb ..... 2/78.2
6,421,839 B1 * 7/2002 Vo et al. ..... 2/227
6,654,962 B2 * 12/2003 DeMott ..... 2/22
6,817,029 B2 * 11/2004 Mazzarolo ..... 2/22
6,854,130 B2 * 2/2005 van der Sleesen ..... 2/69
6,859,943 B1 * 3/2005 Wallace, III ..... 2/228
6,862,744 B2 * 3/2005 Kuroda et al. ..... 2/161.1
6,961,958 B1 * 11/2005 Seitzinger ..... 2/2.5
D522,718 S * 6/2006 Rieder ..... D2/742
7,062,789 B1 * 6/2006 Blackwell ..... 2/79
7,089,596 B2 * 8/2006 Leflet et al. ..... 2/23
7,181,774 B2 * 2/2007 Silver ..... 2/227
7,237,270 B2 * 7/2007 Crye et al. ..... 2/24
7,389,547 B1 * 6/2008 Wiens ..... 2/227
2003/0150042 A1 * 8/2003 Leflet et al. ..... 2/23
2004/0010835 A1 * 1/2004 Mazzarolo ..... 2/22
2005/0066408 A1 * 3/2005 Varela ..... 2/69
2005/0193461 A1 * 9/2005 Caillibotte et al. ..... 2/69
2006/0143800 A1 7/2006 Deffner
2006/0150293 A1 * 7/2006 Toso ..... 2/22
2006/0277651 A1 * 12/2006 Razzaghi et al. ..... 2/81
2008/0040832 A1 * 2/2008 Bay ..... 2/93
2008/0047043 A1 * 2/2008 Flores-Garvey ..... 2/79
2008/0184467 A1 * 8/2008 Brassill ..... 2/455

OTHER PUBLICATIONS

International Preliminary Report on Patentability for Int'l appl. No. PCT/US06/13915; IPEA/US: Mar. 28, 2008; 6 pages.

* cited by examiner 600
604'
620'
CF
614
620
604

600
616
614
608
606
618
CB
612
610'
610
616'
608'
606'
618'

600
606'
618'
CF
614
618
604
604'
606

EQUESTRIAN RIDING BREECHES GARMENT AND METHOD FOR ITS MANUFACTURE

RELATED INVENTIONS

This patent application claims priority from U.S. Provisional Patent Application Ser. No. 60/671,964 filed Apr. 15, 2005, entitled EQUESTRIAN RIDING BREECHES GARMENT AND METHOD FOR ITS MANUFACTURE, and from U.S. Provisional Patent Application Ser. No. 60/683,212 filed May 20, 2005, entitled EQUESTRIAN RIDING BREECHES GARMENT AND METHOD FOR ITS MANUFACTURE, the disclosures of which are incorporated herein by this reference.

BACKGROUND OF THE INVENTION

This invention relates generally to the field of apparatus for riding breeches and manufacture of the same. More particularly, it concerns the problems of grip, stretch, comfort and fit in such garments. Traditionally, such riding breeches are used with English saddles and English riding disciplines, but Western saddles and disciplines would also benefit from improvements in such riding breeches.

Riding breeches having one or more leather patches sewn onto other fabrics in strategic locations are worn by serious equestrians everywhere. Breeches heretofore have been designed to resist wear that would otherwise damage a pair of less durable riding pants lacking such patches. Patches also protect the wearer's skin from rubbing and getting sores. Traditionally, for riders of Dressage, generally contiguous leather patches are sewn onto a pair of pants with an extent along the inner thighs, knees and calf areas and through the crotch and butt regions. The patches are sewn along the inner knee and calf area for riders of other English riding disciplines such as, but not limited to, Hunter/Jumpers, Eventers and Saddle Seat Riders. These are the areas of the riding pants and the athlete's body that undergo the most friction with the equestrian's saddle.

The leather expanses of conventional riding breeches do not stretch or move appreciably—and certainly not adequately—with the equestrian's body. The equestrian's body typically undergoes nearly continuous positional, articulated (e.g. angled) and attitudinal changes while horseback riding. Conventional riding breeches tend to be stiff and confining in the regions of the leather patches, and as a result they diminish the equestrian's mobility, skill, style and grace.

SUMMARY OF THE INVENTION

An equestrian riding garment includes a pair of pants of elastic material having inner leg expanses and a butt expanse of durable material durably but flexibly affixed, e.g. sewn, to corresponding regions thereof, the inner leg and butt expanses being made of real or faux leather that is perforated to increase air permeability and to promote friction with a saddle. Preferably, the butt expanse is bifurcated into left and right sub-pieces corresponding with the equestrian's left and right buttocks. Optionally, a knee region of the inner leg expanses is articulated, as by segmenting. Optionally, an abdominal and/or inner calf region of the pair of pants includes an inner support layer of extra fabric for more flattering fit.

DETAILED DESCRIPTION OF THE PREFERRED EMBODIMENTS

Figure 1:
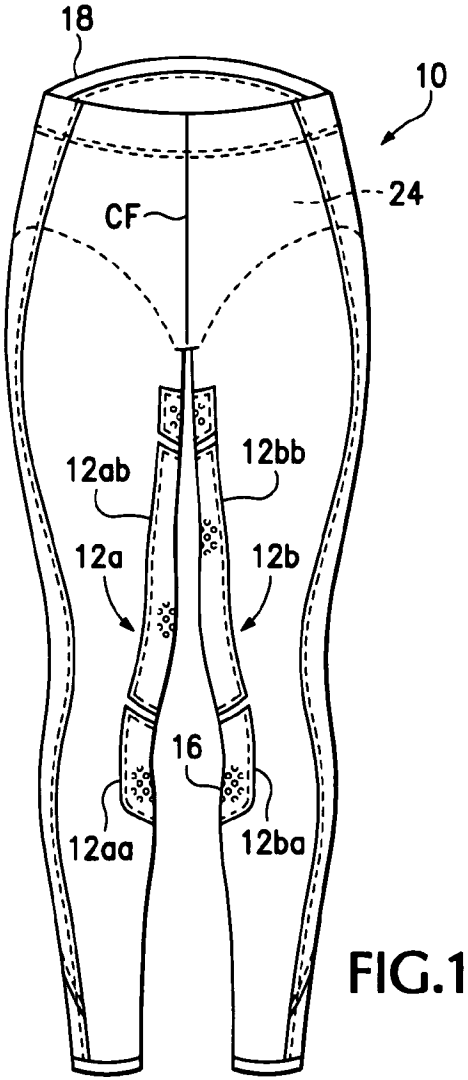
FIG. 1 is a front elevation of the breech garment in accordance with one embodiment of the invention.

The invented F.I.T.S. PerforMAX™ breeches garment from Fun In The Saddle, Inc. of Portland, Oreg., USA improves greatly over conventional breeches in at least two important ways: 1) the leather regions around the buttocks and optionally inside the legs are articulable by pattern bifurcation or segmentation to encourage stretch during the dynamic and even dramatic movements of an equestrian rider; and 2) the leather regions are perforated throughout most of their two-dimensional extent to improve stretch and to increase breath-ability, i.e. air permeability or circulation. The increased stretch promotes not only greater freedom of movement but also better fit and greater comfort for the equestrian rider and wearer of the breeches. The perforations also increase surface tension or drag against a typically leather saddle, thus stabilizing and securing the rider's position in the saddle.

The breeches' tights (also referred to herein simply as a pair of pants), i.e. the expanses underneath the leather regions and elsewhere, are any suitable material and construction, e.g. a conventionally hemmed and seamed double-sided, single-layered material presenting a loop poly inner surface and a nylon outer surface, the tights material being 'breathe-able' or air-permeable. The leather can be real or synthetic (i.e. faux or artificial), smooth or suede. Those of skill in the art will appreciate that other suitable materials can be used, and such materials are contemplated and intended to be within the spirit and scope of the invention. The articulations illustrated in the accompanying drawings include vertical segmentations (produced by horizontal gaps) at knee and crotch level and a horizontal segmentation (produced by a vertical gap) between the buttocks, as shown. This permits much freer articulation movement and flexibility of the rider's knees, hips and pelvis, as well as the desired trochanter rotation, general spreading of the so-called "seatbones" and relaxation of the hips that encourages better horseback riding.

Those of skill will appreciate from the drawings that the breeches garment is lightweight, encourages freedom of movement and removes moisture from the equestrian rider's skin, while presenting an aesthetically pleasing look. In accordance with one embodiment of the invention, the leather patches or pieces do not extend into the central crotch region where the front and rear rises intersect the inseam. Instead, in accordance with the invention, the leather is back an inch or so therefrom, thus to facilitate even greater freedom of movement and breath-ability. Preferably, a separate gusset piece is sewn into the crotch area to allow the garment to conform better to human anatomy.

In accordance with another embodiment of the invention, the abdominal region is reinforced for added support and shaping, as indicated by dashed lines, by a second layer of "power mesh" material. The power mesh gives core body position support to the equestrian's desired riding position and is also very flattering to the wearer, as it minimizes any tummy bulge. Preferably, the inner calf region is made of this same power mesh material. It is an ultra-thin yet extremely durable material that because of its thinness allows the rider's leg to be as close to the horse as possible. This promotes the closest possible contact, feel and communication between horse and rider. Power mesh material is also preferable under tall riding boots. This is because such-boots typically fit very close to the leg and the sleek texture and thin nature of the power mesh make it easier for the rider to put his or her pants on and take them off. Thus, in accordance with this embodiment of the invention, the abdominal and inner calf regions of the tights are of a power mesh material construction.

Figure 2:
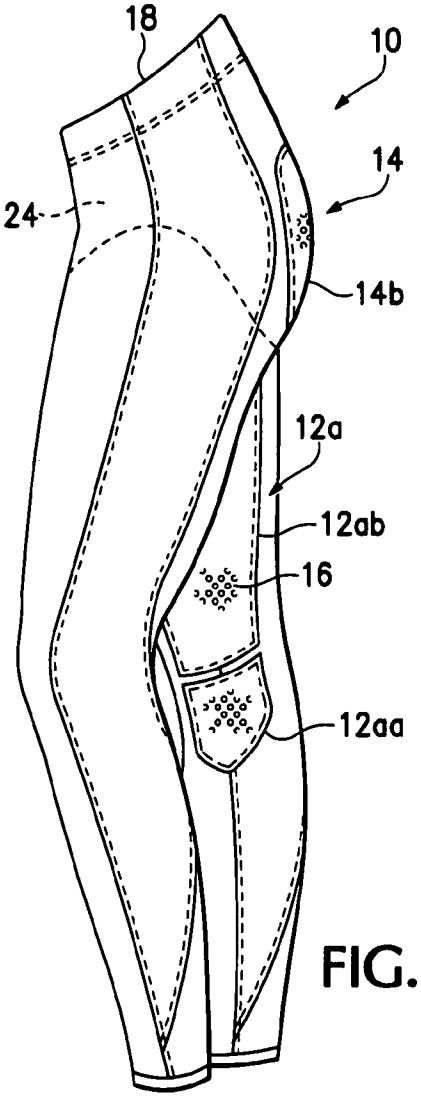
FIG. 2 is a left side elevation corresponding with FIG. 1.
Figure 3:
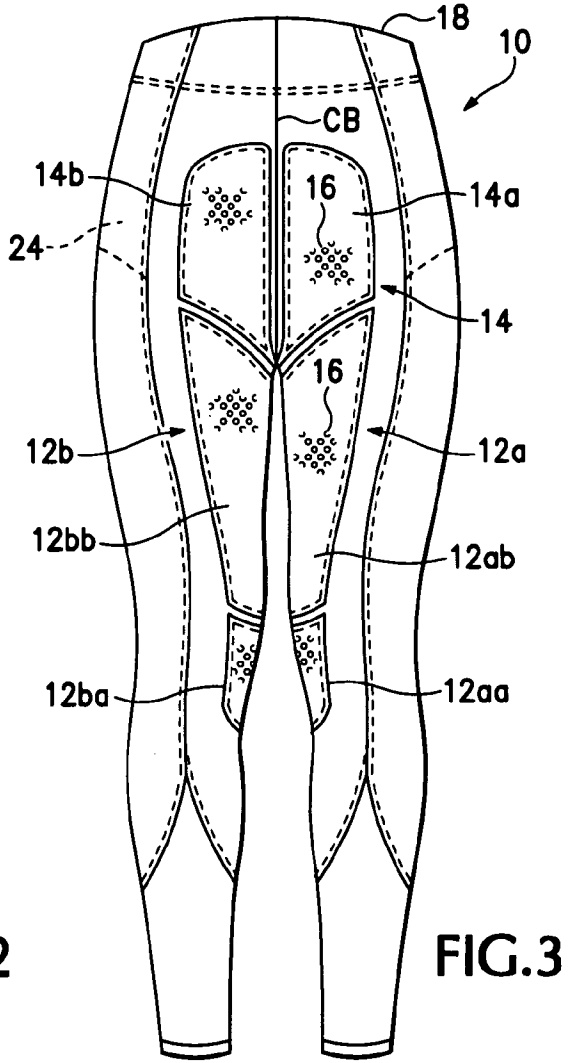
FIG. 3 is a rear elevation of the breech garment corresponding with FIG. 1.

From FIGS. 1, 2 and 3, which respectively are front, left side and rear views of the invented breech garment 10, it may be seen that the preferably perforated leather strips 12*a*, 12*b* along the inner thighs each are bifurcated or segmented into two segments (upper right segment 12*aa*, lower right segment 12*ab*, upper left segment 12*ba* and lower left segment 12*bb*) separated in a generally horizontal line near the articulation of the wearer's knee joint, thereby rendering knee rotation and flexure easier. It may also be seen that another horizontal line of separation segments the rear buttocks or seat panel 14 from the inner thigh strips 12*a*, 12*b*, thereby rendering hip rotation and flexion easier. Finally, it may be seen that a vertical line of separation segments left and right buttocks or seat panel segments 14*a*, 14*b* from one another, thereby rendering waist and hip flexure, e.g. spreading, and/or trochanter flexion/rotation easier.

Those of skill will appreciate that, within the spirit and scope of the invention, the bifurcation or segmentation of the patches of durable material outer lining the insides of the equestrian's legs and buttocks can take alternative forms. For example, tri-furcating or n-furcating the patches into three or more articulable sections or similarly segmenting the same is contemplated. As many partial or full segmentations of the strategically positioned patches as are desired thus would serve to further increase the breathe-ability and flexibility of the patches around the equestrian's articulating knees and spreading buttocks.

Those of skill in the art will appreciate that, within the spirit and scope of the invention, the bifurcation or segmentation of the patches in the region of the knee joints is optional, as is the segmentation of the patch in the region of the buttocks. This is because a much improved riding breeches garment can be rendered by simply perforating the patches to increase flexibility, breathe-ability and grip. Thus, a breeches garment in accordance with one embodiment of the invention can be configured conventionally, but with the important addition of perforations 16. And, alternatively or additionally, a breeches garment in accordance with another embodiment of the invention can be configured with one or both of buttocks segmentation and knee joint segmentation or articulation, but without perforations 16. Finally, in accordance with yet another embodiment of the invention, a breeches garment can be configured with all three improvements, including segmentations or articulations in one or both of the buttocks and knee regions as well as perforations.

It has been found that there are many useful hole or perforation 16 configurations for the real or faux leather patches or other suitable patch material. Useful hole or perforation densities include the following, expressed in terms of perforations per square unit of surface area and resulting percentage of overall surface area represented by perforations or holes.

168 holes/square inch (27% open surface area)
113 holes/square inch (18% open surface area)
81 holes/square inch (14% open surface area)
55 holes/square inch (9.5% open surface area)
27.5 holes/square inch (4.4% open surface area)
14 holes/square inch (2.25% open surface area)

In accordance with one preferred embodiment of the invention, all perforations or holes 16 are generally circular through holes of about 0.04" diameter, with about 81 holes/square inch, resulting in about 14% open surface area. However, other useful hole sizes include those ranging broadly from about 0.01" diameter to about 0.07" or greater diameter and other useful open surface areas include those ranging broadly from about 1% open surface area to about 30% or greater open surface area. It is believed that a substantially uniform hole configuration (shape, size and pattern) and density that produces an open surface are of between approximately 9.5% and 18% represents an excellent balance for the durability, grip, flexibility and breathe-ability of leather, e.g. preferably deerskin, patches. Such variation in hole sizes and open surface areas provides a variety of grip factors, all within the spirit and scope of the invention. Thus, those of skill in the art will appreciate that other perforation or hole shapes, sizes and densities are contemplated as being within the spirit and scope of the invention.

Those of skill will understand that the greater trochanter is the bony protuberance at the distal end of the femur and that opposite greater trochanters tend to move away from one another, i.e. to spread apart the seatbones of the buttocks region. This spreading of the seatbones is very important to equestrians as it helps them greatly improve their seat position in the saddle and enables them to sit softly and securely while their bodies absorb the shock of their mounts' movements. The more dramatic the movement of the horse, the more important this type of seat position. It takes years to develop the skills needed to maintain good seat position. Rotation of the trachanters inwardly, in turn, produces inward rotation of the knees, which also encourages the desired spreading of the seatbones. Unfortunately, conventional riding breeches that have a single, un-bifurcated and unsegmented durable leather patch (i.e. one having a fixed-lateral expanse that is substantially restrictive in accommodating the spreading of the equestrian's seatbones) extending without interruption or flex across both buttocks tend to inhibit such important dynamic anatomical/physical movement of an equestrian, while the invented breech garment 10 greatly facilitates such movement.

Those of skill in the art will appreciate that such perforated leather panel pieces 12*a*, 12*b*, 14*a*, 14*b* as are shown may be conventionally patterned and sized and top-stitched or otherwise suitably affixed to the main fabric of the riding pants or tights 18 made preferably of an air-permeable loop poly inner and nylon outer layers, as illustrated, but alternative materials and construction are contemplated as being within the spirit and scope of the invention. It will be appreciated that the loop poly inner tends to wick moisture from the skin to the nylon outer where it evaporates.

It also will be appreciated that the inner layer, e.g. one or more support panels, 24 (indicated by dashed lines in FIGS. 1-3 and 5A-5C), of power mesh material in the abdominal region adds support for more flattering silhouette. It also will be appreciated that the power mesh adds abdominal/body core support. This provides a stabilizing factor for the equestrian. It also provides a more flattering fit around the stomach, hips and waist. Moreover, the center front (CF) and center back (CB) vertical seams along the rear and front panels of the tights 18 and along the rear legs thereof, in accordance with one embodiment of the invention, also tend to flatten and flatter the shape of the tummy, the butt, the thighs and the calves of the wearer of the invented breeches garment 10. In accordance with an alternative embodiment of the invention, inner layer 24 can be extended to cover the thighs or calves regions of tights 18. In F.I.T.S. PermorMAX™ breeches, this is known as body sculpting muscle support.

Figure 4C:
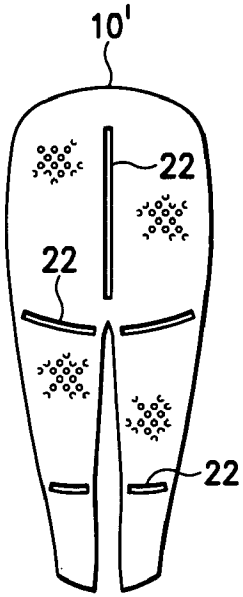
FIGS. 4A, 4B and 4C illustrate alternative embodiments of the invention in which a full-seat breeches garment is equipped with open wedges or removable wedge-shaped patches or slits or cut-outs at stress points.
Figure 4B:
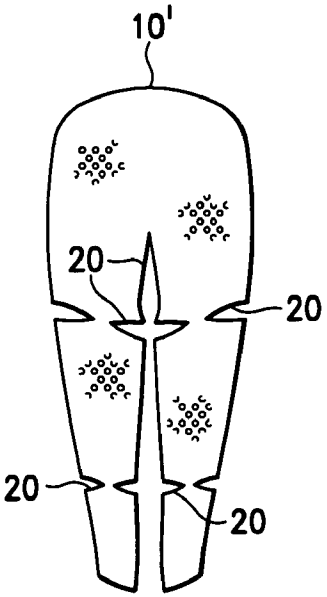
Figure 4A:
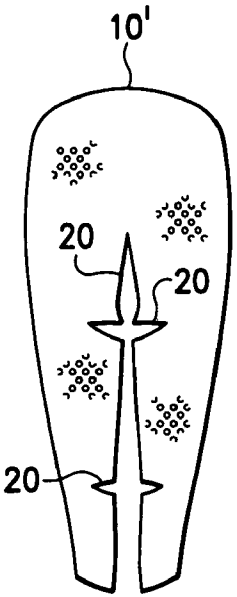

FIGS. 4A, 4B and 4C respectively illustrate alternative embodiments of the invention in which a full-seat breeches garment 10' is modified to interpose plural open wedge-shaped regions 20 formed, for example, by removing plural wedge-shaped patches, or slits or cut-outs 22 at plural strategic stress points corresponding with the segmentation or bifurcation lines described above. The plural wedges 20 represent wedge-shaped sections removed or removable from the suede material and the plural slits or cut-outs 22 represent elongate openings cut thereinto. It will be appreciated that the raw edges of such wedged or slit or cut-out openings can be stitched to guard against tearing. Those of skill in the art will appreciate that the cut-outs or slits 22 act as articulation points that permit the more durable leather sections of the invented breeches garment 10' to be more easily stretched, spread and articulated while the equestrian is riding.

Alternative mechanisms for implementing the spirit and scope of the invented breeches garment invention, while not necessarily described or illustrated herein, nevertheless may fall within the spirit and scope of the invention as ultimately claimed. Thus, any and all suitable means of perforating a faux or real leather outer portion of a riding breeches garment or segmenting or bifurcating its stress points that correspond with limb articulation or heat generation therein are contemplated as being within the spirit and scope of the invention.

Figure 5C:
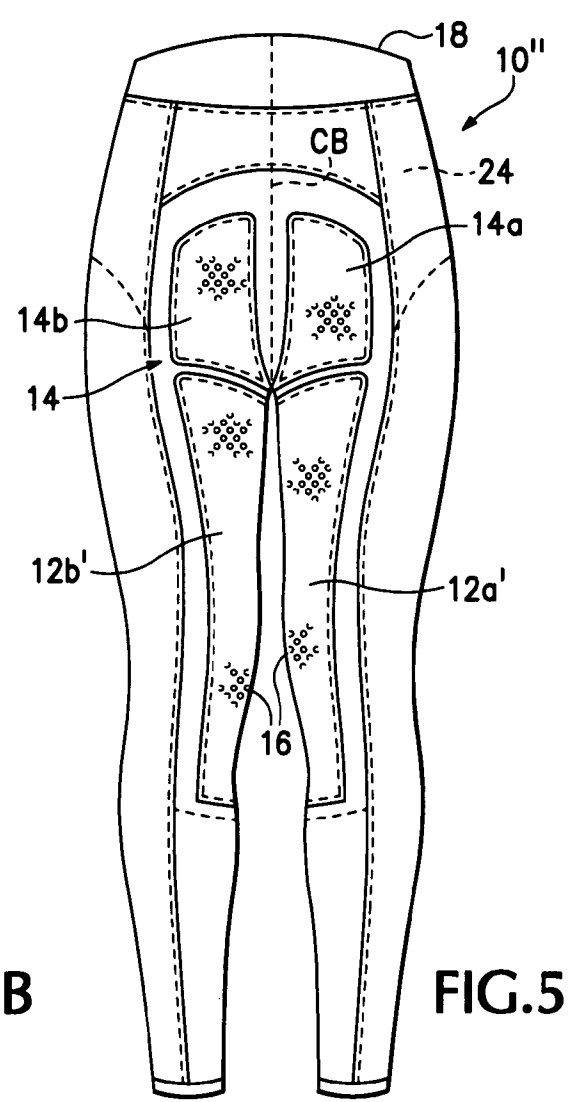
FIGS. 5A, 5B and 5C, respectively, are front, left side and rear elevations of the breech garment in accordance with another embodiment of the invention.
Figure 5B:
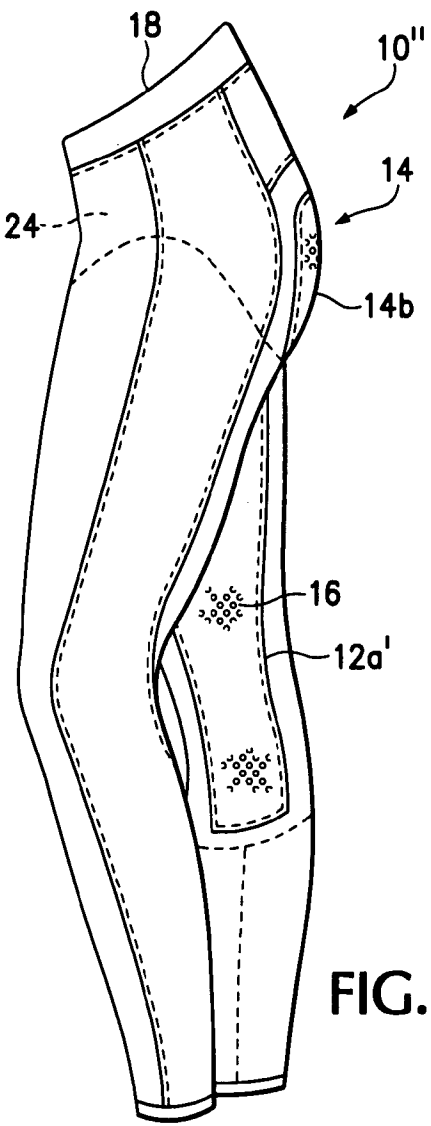
Figure 5A:
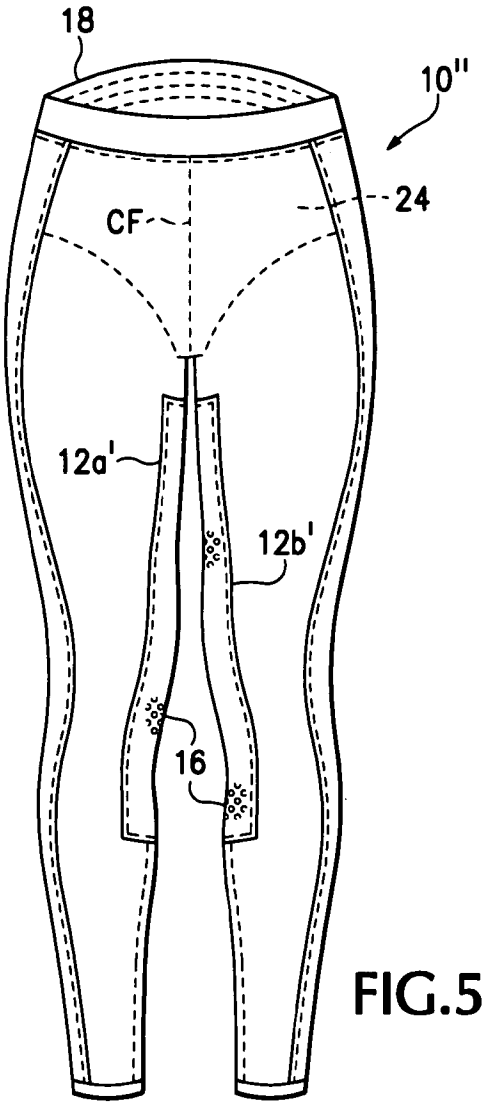

FIGS. 5A, 5B and 5C illustrate yet another embodiment of the invented breeches garment 10" in which the knee joint articulation is absent (wherein similar features are designated with identical, but primed, reference designators, e.g. 10"). As may be seen from the rear elevation of FIG. 5C, the invented breeches garment 10" in accordance with this embodiment includes bifurcated, e.g. segmented, durable garment patches 14*a*', 14*b*' over the region of the equestrian's buttocks. The horizontal segmentation or separation of the left and right semi-patches is defined around what will be understood to be the center back (CB) seam line of the riding pants or tights, as shown. Other details of this embodiment of the invention, e.g. the preferably perforated (16) patch (12*a*', 12*b*', 14*a*', 14*b*') material and the one or more optional abdominal and/or the optional inner calf support panels (24), are similar to those described above with reference to FIGS. 1, 2, 3, 4A, 4B and 4C, and will not be repeated here, although it will be appreciated that patches 12*a*' and 12*b*' are neither bifurcated nor segmented. Nevertheless, a revolutionary breeches garment 10" exhibiting excellent breathe-ability and grip is provided, due to the inclusion of a bifurcated or segmented seat patch and a preferably regular pattern of perforations 16, as described above.

Figure 6A:
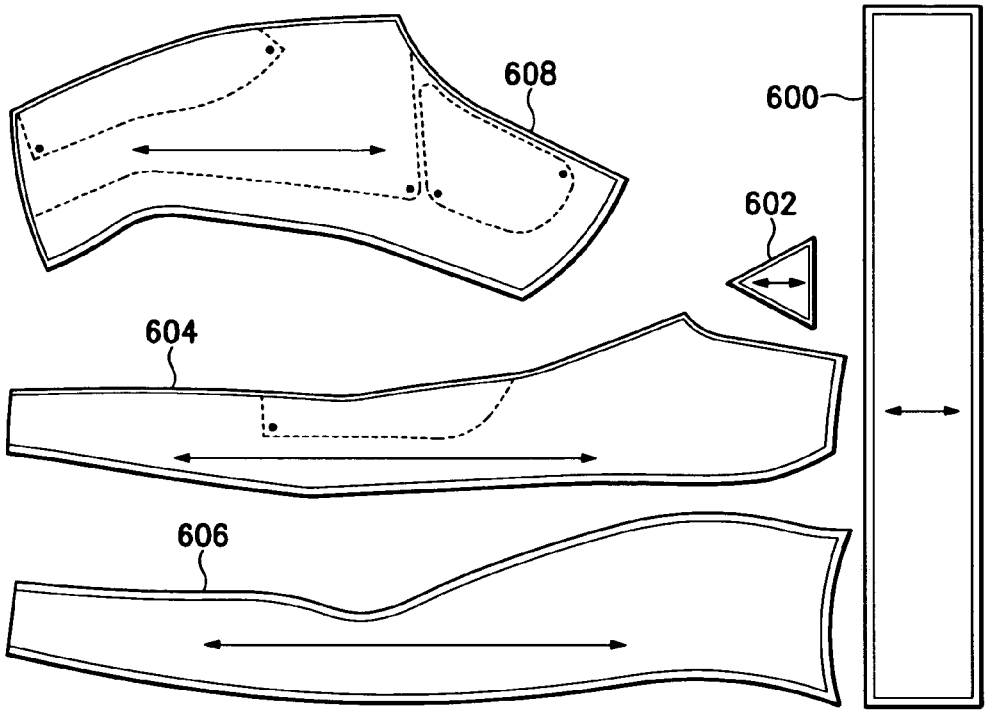
FIGS. 6A and 6B are plan views of the tights garment pattern pieces and the leather patch pattern pieces.
Figure 6B:
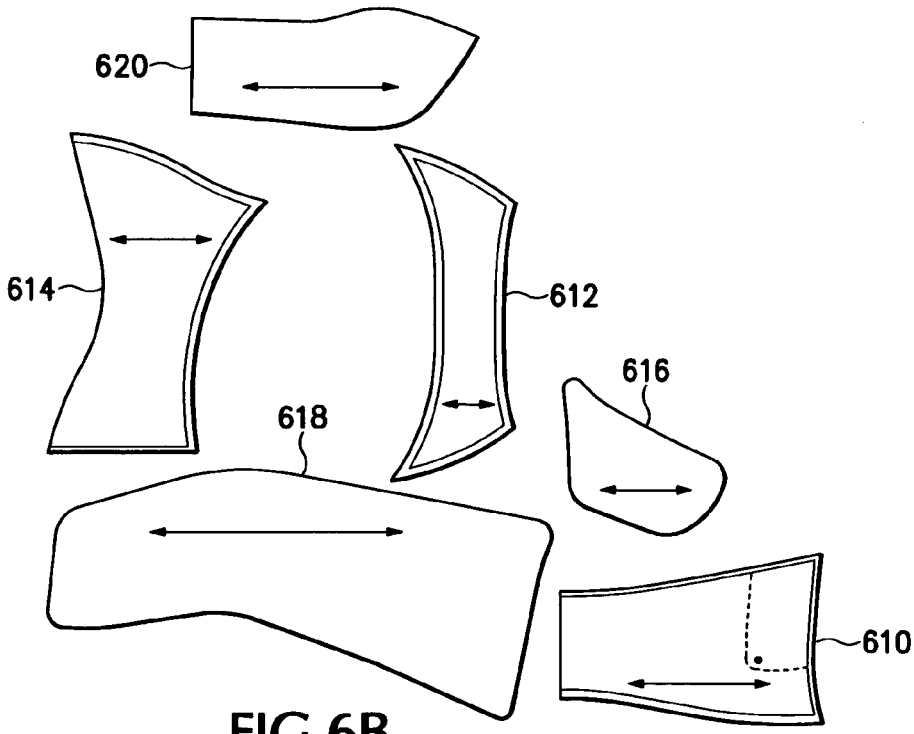

FIGS. 6A and 6B illustrate the various tights pattern and patch pattern pieces that are used in accordance with two alternative preferred embodiments of the invention to manufacture the invented breeches garment. Those of skill in the art will appreciate that the double-ended arrows in FIGS. 6A and 6B indicate the grain line of the fabric, and that the double solid lines indicate each to-be-sewn piece's seam allowance. Those of skill also will appreciate that the dash-dot or dashed-line overlays of the otherwise solid pattern outlines indicate the position and orientation thereon of the various leather patches, in accordance with two alternative preferred embodiments of the invention.

Finally, those of skill will appreciate that the same reference designators used in connection with FIGS. 6A and 6B to describe pattern pieces will be used in connection with the invented garment embodiments of FIGS. 7A, 7B , 7C and 7D to describe garment and patch pieces made therefrom, with mirror-image pieces having complementary reference designators, e.g. left and right butt patches 616 and 616', respectively.

FIGS. 6A and 6B show a rectangular waistband pattern piece 600, a triangular gusset pattern 602, a front pant pattern piece 604, a side pant pattern piece 606, a back pant pattern piece 608, a back calf pattern piece 610, a back yoke pattern piece 612 and a front panel pattern piece 614. From the discussion above, it will be understood by those of ordinary skill in the art that pieces of the tights corresponding with these pattern pieces are sewn together (as will be seen by reference to FIGS. 7A and 7B) to make the tights 'undergarment' that forms a part of the invented breeches garment. Since tights making is relatively conventional, this part of the invented method will not be discussed in detail herein. But it should be noted that the use of side panels enables an extremely form-fitting, trimming, athletic look in a very functional breeches garment. It is also noted that the front panel—which extends from the out-seam between the left back pant and the left side pant piece, across the left side pant piece, across two adjacent front pant pieces and across the opposing right side pant piece all the way to the out-seam between the right side pant piece and the right back pant piece—is extremely effective in flattening the wearer's tummy and lateral hip regions. It is also noted that the optional use of opposing back calf pieces made of power mesh material greatly facilitates the slipping on of an equestrian's riding boots, because they provide a very smooth sliding surface in a critical region of the equestrian's lower legs.

FIGS. 6A and 6B also show an optional upper butt patch segment pattern piece 616, an optional full-seat lower (inside thigh) patch pattern piece 618 and an optional knee patch pattern piece 620. Those of skill will appreciate that opposite upper butt patches made from pattern piece 616 are greatly preferred in most embodiments of the invention. They are bifurcated or segmented, e.g. separated, by a gap of approximately 1 centimeter (1 cm) from their respective opposite lower patches made from pattern piece 618, as may be appreciated. They are also bifurcated or segmented, e.g. separated from each other by a gap of approximately 1.5 cm. These important segmentations or bifurcations promote freedom of movement and flex of the equestrian while horse-back riding, especially for use in Dressage. On the other hand, breeches garments providing only inner knee patches and no butt patches also are extremely useful, especially for use by Hunters/Jumpers. In either event, perforated leather patches provided, in accordance with the invention, in strategic locations on the outside of the tights yield unprecedented and unparalleled fit, flex, grip and comfort.

Figure 7D:
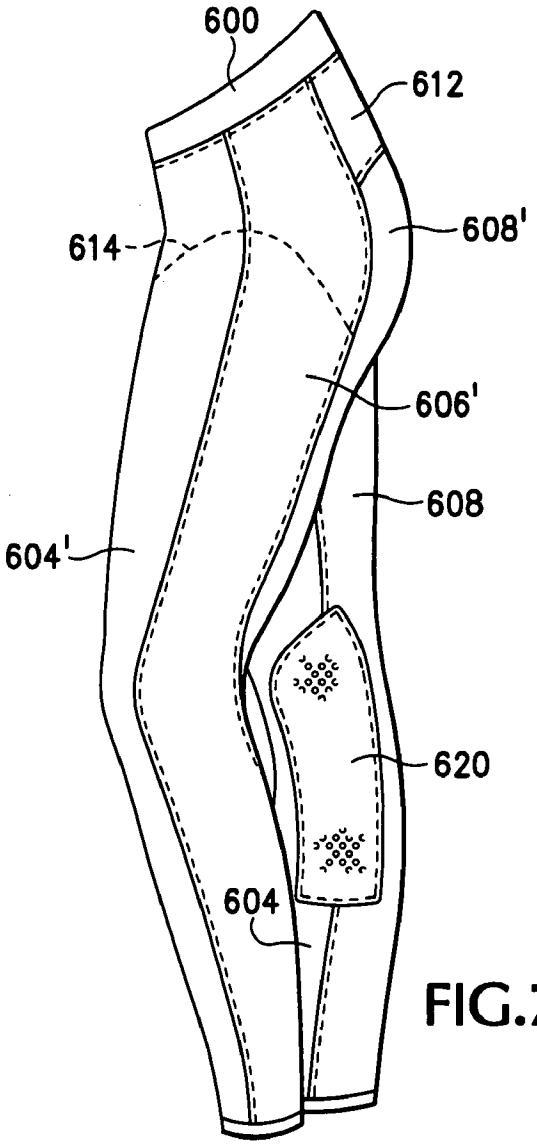
FIGS. 7C and 7D, respectively, are front and side elevations of another preferred embodiment of the invention in which perforated-leather, segmented-partial-seat and knee-patch flexibility, durability and grip are provided.
Figures 7A, 7B, 7C:
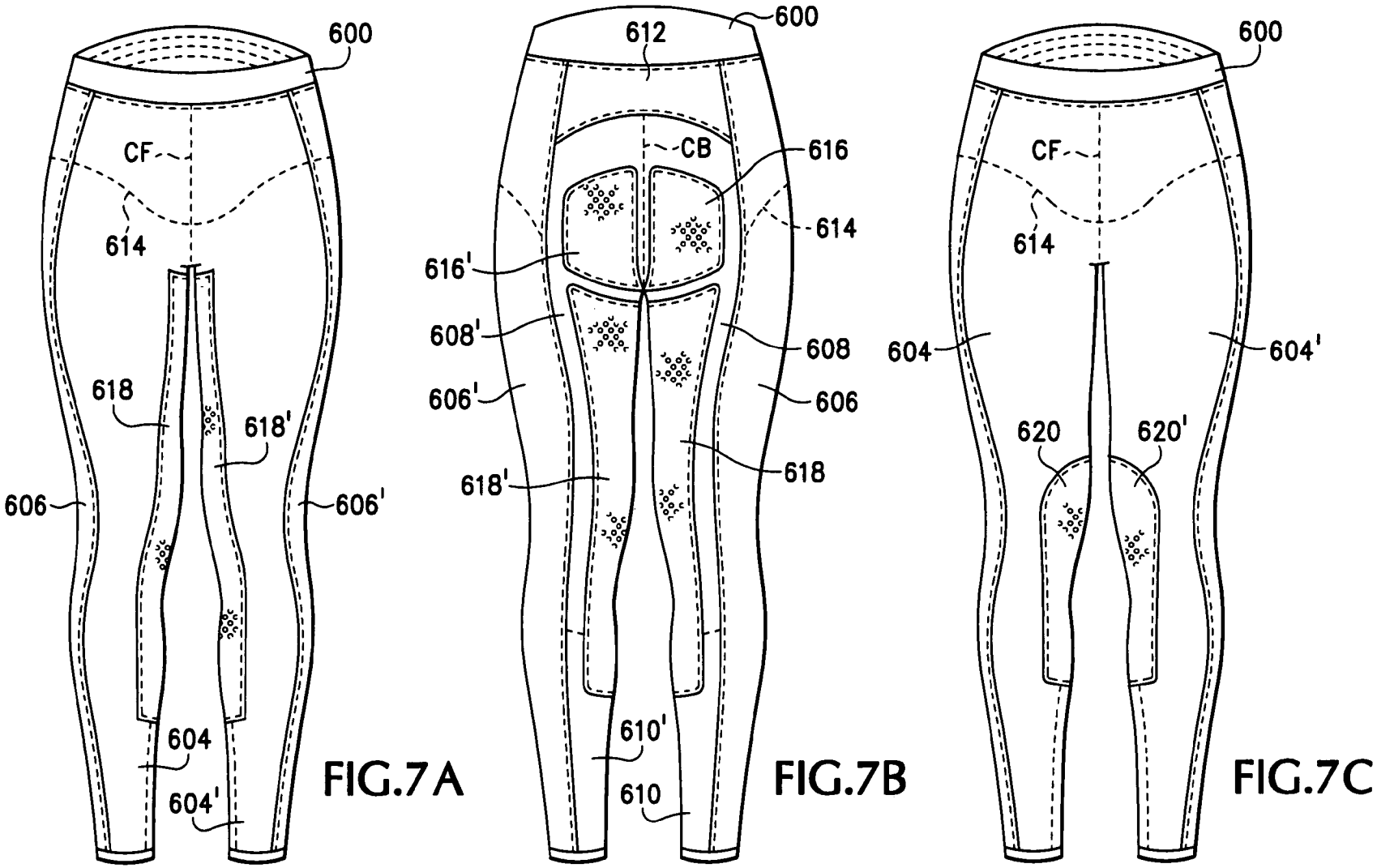
FIGS. 7A and 7B, respectively, are front and rear elevations of one preferred embodiment of the invention in which perforated-leather, segmented-full-seat flexibility, durability and grip are provided.

FIGS. 7A and 7B illustrate an assembled version of one preferred embodiment of the invention referred to as the "full-seat style" in which either buttock, either inner thigh, either knee and either calf is provided with a relatively long lower patch 618, whereby FIGS. 7C and 7D illustrate an assembled version of an alternative preferred embodiment of the invention referred to as the "knee patch style", in which either inner knee and calf are provided with a relatively short lower patch 620. In all cases, the patches wherever they are located are preferably made of leather that is perforated in accordance with the invention to increase fit, flex, grip and breathe-able comfort.

Those of skill in the art will appreciate from FIGS. 7A and 7B the fit, flex, grip and comfort tradeoffs involved in sizing and locating the leather patches. The greater the surface area of the patches, the better the grip, but the less trim the fit, the less flexible the movement and the less breathe-able the garment. Conventional riding breeches that provide a durable, e.g. leather, patch extend the patch material continuously up the inner thighs and around the buttocks, greatly limiting the equestrian's flexibility at the waist where it is most important. Conventional patched riding breeches also extend the leather patch material continuously across the left and right buttocks, greatly limiting the equestrian's hip spread and trochanter rotation. Conventional patched riding breeches often extend the leather patch material through the crotch region, greatly reducing the equestrian's riding comfort and flexibility. Thus, all conventional approaches reduce the equestrian's comfort due in part to the lack of air permeability or breathe-ability of the extensive patch fabric and in the way they restrict motions.

The invented riding breeches garment solves these prior art problems by strategically placing perforated leather patches only where they are needed to improve grip on the mount's saddle. Those of skill in the art will appreciate that in accordance with the invented breeches garment, triangular gusset 602 made of a lightweight, breatheable fabric extends in the crotch region near the apex of the inseam between adjacent front pants pieces 604 and adjacent back pants pieces 608. Those of skill in the art also will appreciate that in accordance with the invented breeches garment, back calf pieces 610 cover a strategic region of the equestrian's lower rear and inside calf, greatly facilitating the donning of riding boots and even trimming the calves. Finally, those of skill will appreciate that in accordance with the invented breeches garment, the lower edges of butt patches 616, 616' (FIG. 7B) and the upper edges of full-seat lower patches 618, 618' substantially conform at the gap therebetween with the defining curve of the equestrian's buttocks.

FIGS. 7C and 7D illustrate an alternative preferred embodiment of the invented riding breeches garment having only lower (inner) knee patches 620, but no butt patches and no inner thigh patches. Otherwise, those of skill in the art will appreciate, the breeches garment is identical to that described in detail above and enjoys similar advantages of fit, flex, grip and comfort. This is because knee patches 620 are strategically located where grip is most needed and are perforated to increase friction and to render the breeches garment breathable. In either case, the breeches garment provides a flattering fit due to the chosen tights materials, side pant panels, tummy-tucking abdominal panel, high waistband and yoke, gusseted crotch and smooth-gliding power-mesh calf panels.

It will be understood that the present invention is not limited to the method or detail of construction, fabrication, material, application or use described and illustrated herein. Indeed, any suitable variation of fabrication, use, or application is contemplated as an alternative embodiment, and thus is within the spirit and scope, of the invention.

From the foregoing, those of skill in the art will appreciate that several advantages of the present invention include the following.

The present invention provides many advantages over conventional breeches. The articulation, e.g. bifurcation or segmentation, of the riding breeches' faux or real leather patches in the region of the knees provides unprecedented angular flexibility and comfort during the constant riding motion. The bifurcation or segmentation of the riding breeches' faux or real leather patch in the region of the buttocks provides unprecedented flexibility, spread and comfort. The perforation of the faux or real leather patches provides unprecedented breathe-ability, or air permeability. Moreover, the perforations have been discovered to offer another surprising advantage: increased frictional engagement between the riding breeches in the areas of the patches and the riding saddle where they come into contact with one another. Thus, an equestrian's grip on the saddle and the horse underneath are improved. Finally, the power mesh reinforcement of the elastic tights in the lower torso provides unprecedented comfort under tall riding boots and the closest possible leg-to-flank contact between horse and rider.

It is further intended that any other embodiments of the present invention that result from any changes in application or method of use or operation, method of manufacture, shape, size, or material which are not specified within the detailed written description or illustrations contained herein yet are considered apparent or obvious to one skilled in the art are within the scope of the present invention.

Accordingly, while the present invention has been shown and described with reference to the foregoing embodiments of the invented apparatus, it will be apparent to those skilled in the art that other changes in form and detail may be made therein without departing from the spirit and scope of the invention as defined in the appended claims.

I claim:

1. An equestrian garment comprising:

a pair of pants with a waist, a crotch region, a butt piece, a front piece and a pair of leggings;

first and second inner leg expanses made of a durable material affixed over the inside expanses of the pair of leggings, wherein the first and second inner leg expanses are dimensioned to extend below an equestrian's knees and are configured to articulate therearound, and wherein the articulate configurations each involve a material bifurcation between an upper expanse extending above the knee and a lower expanse extending below the knee, wherein the first and second inner leg expanses are dimensioned further to extend along the inner thigh above the equestrian's knees, and a butt expanse made of a durable material affixed over the butt piece, wherein the first and second inner leg expanses are configured to extend through an upper inner thigh region, wherein the butt expanse is separate and spaced apart from the first and second inner leg expanses, the first and second inner leg expanses and the butt expanse being made of a real or artificial leather material.

2. The garment of claim 1, wherein the first and second inner leg expanses are separate and spaced apart from one another near the crotch region.

3. The garment of claim 1, wherein the butt expanse is separate and spaced apart from the first and second inner leg expanses.

4. The garment of claim 1, wherein each bifurcation includes a separation and spacing apart of each of the upper expanses and corresponding lower expanses.

5. The garment of claim 1, wherein the bifurcation includes a region of joinder and a region of separation between each of the upper expanses and corresponding lower expanses.

6. The garment of claim 5, wherein each of the upper expanses and the corresponding lower expanses extend relative to one another generally in parallel away from the region of joinder.

7. The garment of claim 5, wherein each of the upper expanses and the corresponding lower expanses diverge from one another away from the region of joinder.

8. The garment of claim 1, wherein the butt expanse is bifurcated between a right and a left semi-expanse to align respectively with the equestrian's right and left buttock.

9. The garment of claim 8, wherein the bifurcation involves a separated and spaced-apart right and left semi-expanse in such alignment.

10. The garment of claim 8, wherein the bifurcation involves a region of joinder and a region of separation between the right and left semi-expanses in such alignment.

11. The garment of claim 10, wherein the right and left semi-expanses in the region of separation extend generally in parallel with one another away from the region of joinder.

12. The garment of claim 8, wherein the pair of pants are made of a double-sided, single-layered, bi-material mesh fabric.

13. The garment of claim 12, wherein the waist, crotch, butt piece, front piece and lower leggings around the equestrian's lower torso and calves are reinforced with a second layer of fabric.

14. The garment of claim 1, wherein the leather material of the first and second inner leg expanses and of the butt expanse includes perforations generally uniformly arrayed thereacross, thereby to increase air permeability and to promote friction with an equestrian saddle.

15. An equestrian garment comprising:

A pair of stretch pants with a waist, a crotch region, a butt region, a front region and a pair of leggings, the pants being made of an elastic fabric;

first and second inner leg expanses made of a durable material affixed to the inside expanses of the pair of leggings, wherein each of the first and second inner leg expanses is dimensioned to extend below an equestrian's knee and is configured to articulate near a region thereof, and wherein each of the first and second inner leg expanse includes a material bifurcation between an upper expanse and a lower expanse, the material bifurcations of the first and second inner leg expanses exposing the elastic fabric of the pants in gaps formed by the bifurcations; and a butt expanse made of a durable material affixed to the butt region, the first and second inner leg expanses and the butt expanse being made of a real or artificial leather material, and the first and second inner leg expanses being separate and spaced apart from one another and each being separate and spaced apart from the butt expanse such that the first and second inner leg expanses and the butt expanse do not extend into the crotch region, thereby exposing the elastic fabric of the crotch region of the pair of pants.

16. The garment of claim 15, wherein the butt expanse is bifurcated into two distinct butt expanse areas.

17. The garment of claim 15, wherein each of the first and second inner leg expanses each is tapered down in width substantially from a top to a bottom thereof.

18. The garment of claim 15, wherein the crotch region of the pair of pants is open and free of the durable material from both the first and second inner leg expanses and the butt expanse.

19. The garment of claim 15, wherein the butt expanse is configured to extend downwardly on a butt of a wearer of the garment to a region above the wearer's butt line.

20. The garment of claim 15, wherein the real or artificial leather material includes perforations generally uniformly arrayed thereacross, thereby to increase air permeability and to promote friction with an equestrian saddle.

21. The garment of claim 15, wherein each material bifurcation includes a slight separation and spacing apart of each of the upper expanses and corresponding lower expanses.

* * * * *